US007726327B2

(12) United States Patent
Battiston

(10) Patent No.: US 7,726,327 B2
(45) Date of Patent: Jun. 1, 2010

(54) UNIVERSAL MOUNT FOR A WALKER

(75) Inventor: Joseph Battiston, Sutherland, VA (US)

(73) Assignee: Tubular Fabricators Industry, Inc., Petersburg, VA (US)

( * ) Notice: Subject to any disclaimer, the term of this patent is extended or adjusted under 35 U.S.C. 154(b) by 0 days.

(21) Appl. No.: 11/537,031

(22) Filed: Sep. 29, 2006

(65) Prior Publication Data

US 2008/0078431 A1 Apr. 3, 2008

(51) Int. Cl.
*A61H 3/04* (2006.01)

(52) U.S. Cl. ..... 135/67; 135/66; 482/68; 280/87.021

(58) Field of Classification Search ..... 135/65–67, 135/85; 280/304.1, 87.021, 87.051, 250.1; 482/67–68; 297/5–9; 248/558, 911–912, 248/230.2; 224/407
See application file for complete search history.

(56) References Cited

U.S. PATENT DOCUMENTS 2,459,066 A * 1/1949 Duke ..... 297/5
2,759,525 A 8/1956 Ries
2,796,916 A 6/1957 Womble
2,855,024 A 10/1958 Robb
3,488,088 A * 1/1970 Goldberg et al. ..... 297/5
3,708,182 A * 1/1973 Markiel ..... 280/288.4
4,187,869 A * 2/1980 Marchetti ..... 135/67
4,248,256 A 2/1981 Thomas
4,251,044 A 2/1981 Olson
4,428,390 A 1/1984 Baird
4,491,257 A 1/1985 Ingles
4,640,301 A * 2/1987 Battiston et al. ..... 135/67
4,748,994 A 6/1988 Schultz et al.
4,795,182 A * 1/1989 Dyess et al. ..... 280/304.1
4,869,279 A * 9/1989 Hedges ..... 135/67
4,913,393 A * 4/1990 Wood ..... 248/230.2
D311,364 S 10/1990 Wood
4,987,912 A * 1/1991 Taylor ..... 135/67
5,056,545 A 10/1991 Spaeth
5,123,126 A * 6/1992 Vincent ..... 4/480
5,135,191 A * 8/1992 Schmuhl ..... 248/125.1
5,148,559 A * 9/1992 Morris ..... 5/86.1
5,180,181 A * 1/1993 Letechipia ..... 280/304.1
5,275,426 A * 1/1994 Tankersley ..... 280/87.051
5,349,977 A 9/1994 Wood
5,524,657 A * 6/1996 Jih ..... 135/66
5,647,602 A * 7/1997 Nevin ..... 280/87.021

(Continued)

FOREIGN PATENT DOCUMENTS

JP 2000024062 A * 1/2000

OTHER PUBLICATIONS

Website, www.sammonspreston.com 1 page.

*Primary Examiner*—Winnie Yip
(74) *Attorney, Agent, or Firm*—Thomas, Karceski, Raring & Teague, P.C.

(57) ABSTRACT

A walker includes a universal mount adapted to interchangeably receive multiple different attachments useful for a patient using the walker. A single walker may have an array of attachments adapted to be interchangeably used by a particular user. Alternatively, a care provider may stock a single walker available for use by many different patients, because individual needs may be met by the different attachments that may be interchangeably used with the mount on the single walker.

18 Claims, 10 Drawing Sheets

U.S. PATENT DOCUMENTS 5,687,942 A * 11/1997 Johnson ..... 248/223.41
5,692,762 A * 12/1997 Obitts ..... 280/87.05
5,702,326 A * 12/1997 Renteria ..... 482/68
5,704,577 A * 1/1998 Gordon ..... 248/229.2
D399,795 S 10/1998 Rauscher et al.
5,901,891 A * 5/1999 Douglass ..... 224/407
6,231,016 B1 * 5/2001 Slone ..... 248/200.1
D472,187 S 3/2003 Tomlinson
6,672,321 B2 1/2004 Hamilton
D507,212 S 7/2005 Tomlinson
6,990,990 B2 1/2006 Wilensky et al.
7,021,324 B1 4/2006 Clay et al.
7,275,554 B2 * 10/2007 Mullholand ..... 297/6
2002/0157693 A1 10/2002 Whitmer
2004/0129305 A1 7/2004 Hamilton et al.
2005/0076939 A1 4/2005 Karasin et al.
2005/0236025 A1 10/2005 Gale et al.
2006/0016466 A1 1/2006 Carroll

* cited by examiner

UNIVERSAL MOUNT FOR A WALKER

The present invention relates generally to a walker, and in particular to a walker having a universal mount adapted to interchangeably receive multiple different attachments useful for a patient using the walker.

BACKGROUND

Many patients have some type of infirmity, whether temporary or otherwise, that requires the use of a walker to assist with ambulation. By definition, a walker requires the use of one or both hands by a patient when going anywhere. As a result, a patient's hands are essentially fully occupied by the walker during use.

As a result of the foregoing, many different walkers are engineered with different attachments for use by patients. For instance, a walker may be specifically engineered to receive and carry an oxygen bottle or a tray or an umbrella or one of many other types of attachments to a walker in order to allow that patient to carry or transport the various items. The problem is when patients require different attachments at different times. A patient may need a basket to carry various items one day and an umbrella to take a walk in the rain another day. Or, in the case of a health care provider that reuses walkers with different patients, there may be a need for an oxygen bottle carrier for one patient, an IV pole for another, and a stroke handle for still another. Therefore, there is a need for a walker having a universal mount adapted to interchangeably receive multiple different attachments that may be used with a walker.

SUMMARY

Accordingly, it is an object of the present invention to overcome the foregoing drawbacks and provide a walker with a universal mount for interchangeably receiving multiple different attachments. The mount is fixed to the walker. A plurality of different attachments each has a connecter adapted to be received in the universal mount. A single walker, therefore, may have an array of attachments for a particular user. Alternatively, a care provider may stock a single walker available for use by many different patients, because individual needs can be met by the different attachments used with the single walker.

In one example, a walker for assisting a patient with mobility comprises a pair of side frames. A cross member is connected on each end to each side frame. A universal mount is fixed to the cross member wherein the mount is adapted to interchangeably receive a plurality of different attachments. The attachments may be selected from the group consisting of oxygen tank holders, handles, IV poles, baskets, cane holders, trays, arm rests, and umbrella holders. The universal mount may comprise a tubular element having a plurality of apertures therein, each aperture adapted to receive a detent. The tubular element may also have a plurality of notches, each notch adapted to receive a detent. The side frames may be rotatable connected to the cross member and releasably and lockably connected to the cross member. The walker may further comprise a second cross member with the universal mount fixed to both cross members. The universal mount may also be fixed to both cross members on the back side of both cross members. The universal mount may be fixed to the center of the cross member substantially equidistant from each side frame.

In another example, a walker kit for assisting a patient with mobility includes a pair of side frames. A cross member connects on each end to each side frame. A universal mount is fixed to the cross member, wherein the mount is adapted to interchangeably receive a plurality of different attachments. The kit farther includes a plurality of attachments, each having a universal connecter adapted to be interchangeably received in the universal mount. The universal mount may comprise a tubular element that matingly receives the universal connector. The universal connector may comprise a male element that is received by the universal mount that comprises a female element.

DETAILED DESCRIPTION

Figure 1:
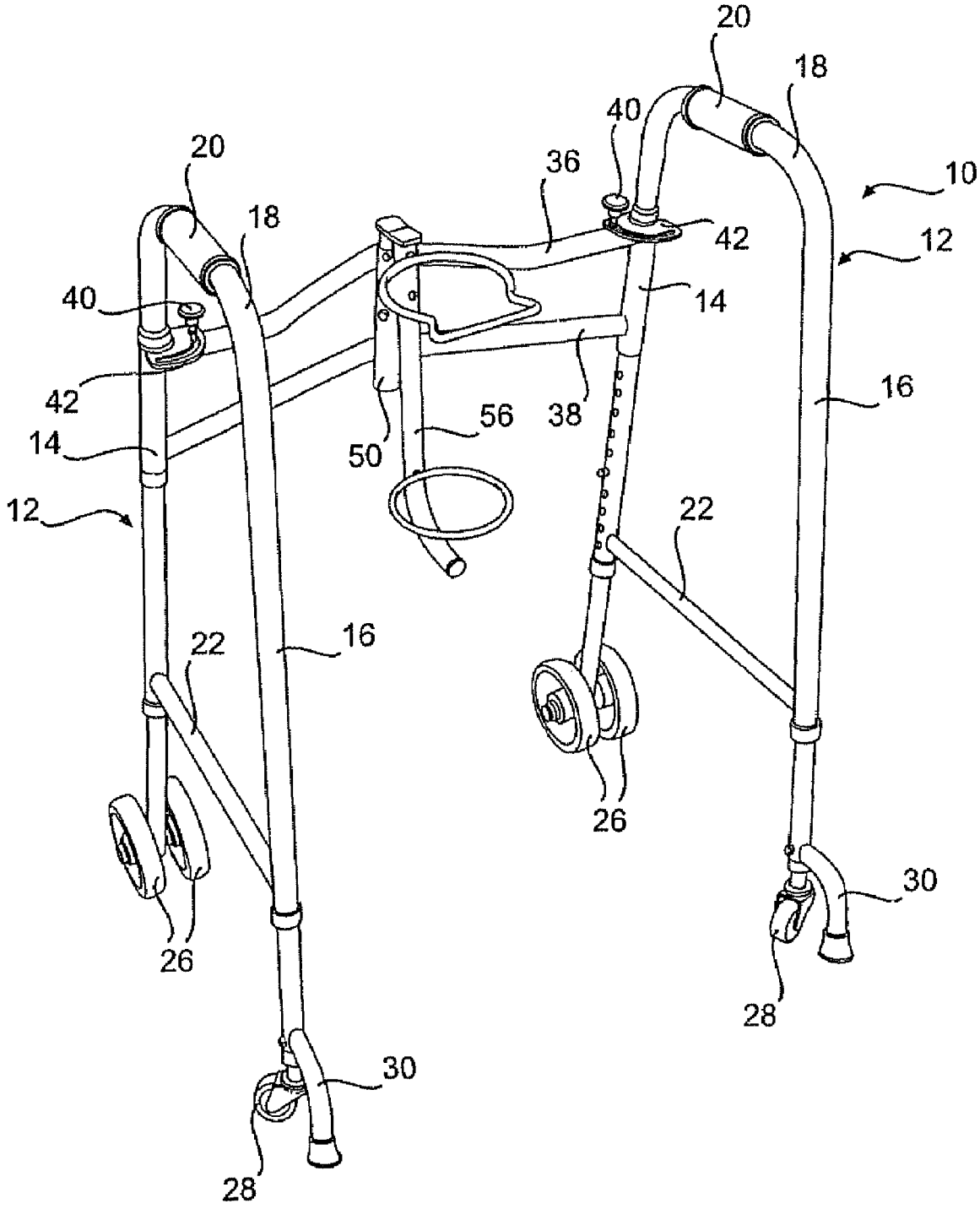
FIG. 1 is a rear perspective view of a walker in accordance with an example of the present invention.

Conventional walkers are known to have specially customized devices to attach specific apparatuses to the walkers. For instance, a special oxygen bottle cradle may be attached to a walker. Another walker may have a clamp assembly for an IV pole. A still further walker may include a clip or loop for a basket to be mounted on a walker.

The present invention is a mount fixed on a walker in combination with one or more attachments having a universal connector adapted to be received in the mount. The different attachments may include, but are not limited to, at least the following: oxygen tank holders, handles, IV poles, baskets, cane holders, trays, armrests, and umbrella holders. Each attachment includes a universal connector component.

Turning now to the drawings, there is shown in the figures a walker 10 having a conventional construction. The walker 10 includes side frames 12 that have a generally u-shape. The walker 10 includes front legs 14 and rear legs 16 that are each substantially vertical. The front and rear legs 14 and 16 are connected between their upper ends by a pair of handrails 18 that connect the upper ends of each of the front and rear legs. The handrails 18 are shown having a grip 20 attached thereto for easy handling by a user. Wheel assemblies 26 are mounted at the bottom of the front legs 14. Spring-loaded wheels 28 and/or a rear foot 30 is attached to the lower end of the rear legs 16. Additional side support beams 22 are connected on either end to the front and rear legs 14 and 16 for additional stability.

Cross members 36 and 38 are connected on each end to the front leg 14 of each of the side frames 12. A walker may include one or more cross members like cross members 36 and 38. These cross members 36 and 38 are shown with some curvature. They may take other shapes and forms. There may be a single cross member that is reinforced at each end with respect to its attachment to the side frames 12. The side frames 12 are shown as being rotatably connected to the cross members 36 and 38. This allows the walker 10 to be rotated to a folded position for storage and transport. A locking mechanism including a pin 40 and slotted plate 42 cooperate to allow a user to lock the walker 10 in the open position shown. By depressing the locking button 40, the side frames 12 can be rotated to the folded storage position.

A conventional walker 10 is shown, but alternative walker constructions may be used. For instance, a walker may have a single length of tube that forms part of a leg on each side frame and the cross member. In another example, the side frames may have an inverted y shape with a cross member connected to the end of the y on each side. Other geometries of walker can be configured. While the side frames and cross member are discussed separately, they could include integral pieces or merely sections of a particular walker construction.

Figure 4:
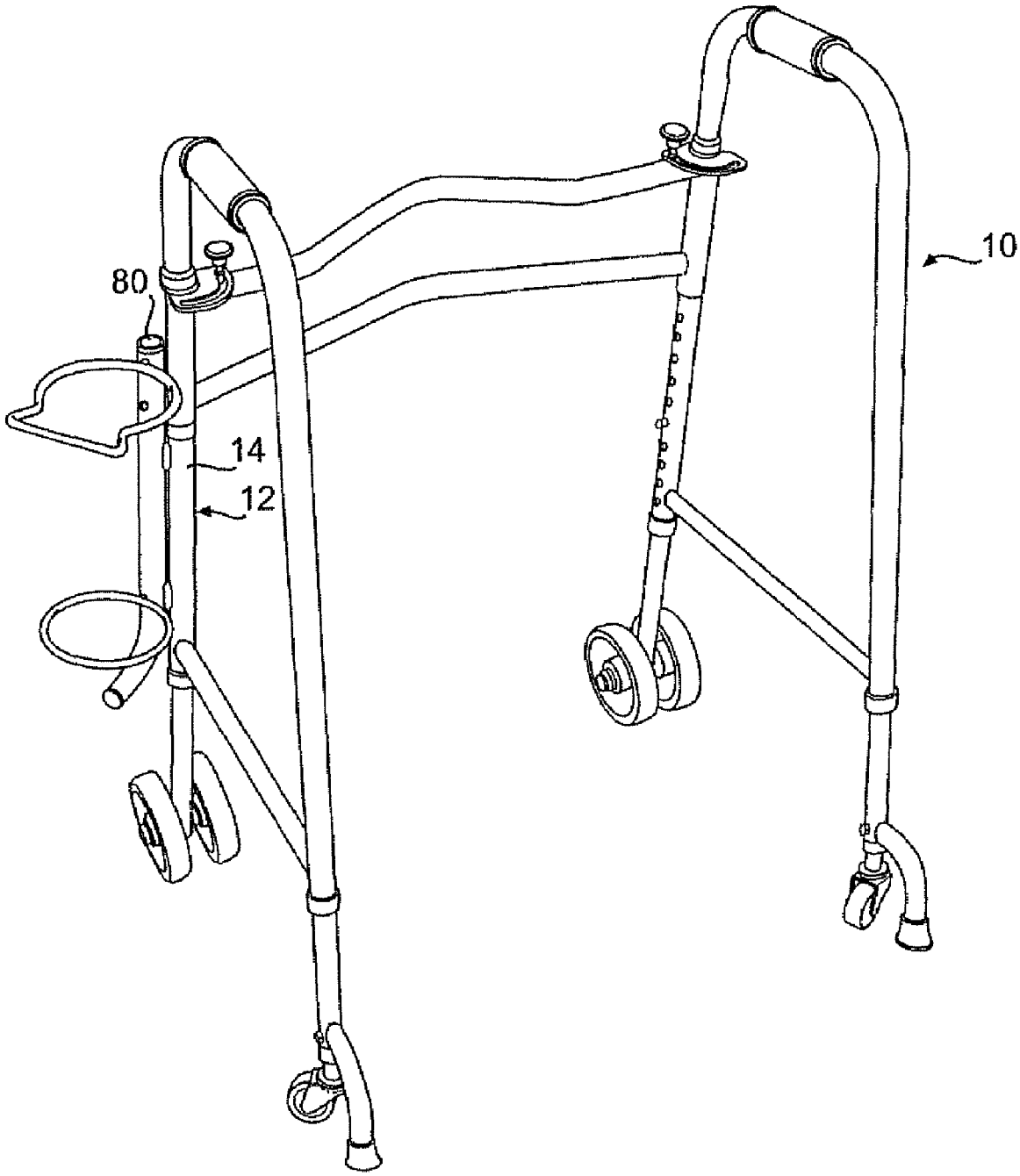
FIG. 4 is a rear perspective view of the walker in accordance with FIG. 1 wherein the mount is fixed on a front leg of the walker.

Returning now to the figures, a tubular mount 50 is fastened to the cross members 36 and 38 on the back side of those cross members. Stated another way, the mount 50 is situated within the space defined by the inside of the walker when opened to the position shown in the figures. By placing the mount 50 on the back side of the cross members 36 and 38, the center of gravity of the walker is improved and reduces the chance for tipping or other possibly serious events. Also, the mount 50 is shown as being fastened to substantially the middle of the cross members 36 and 38 so that it is generally equidistant from each of the side frames 12. As shown, for instance, in FIG. 4, a mount 80 could be fastened elsewhere on the walker structure. For instance, in FIG. 4, a tubular mount 50 is mounted on the front leg 14 of a side frame 12.

Figure 2:
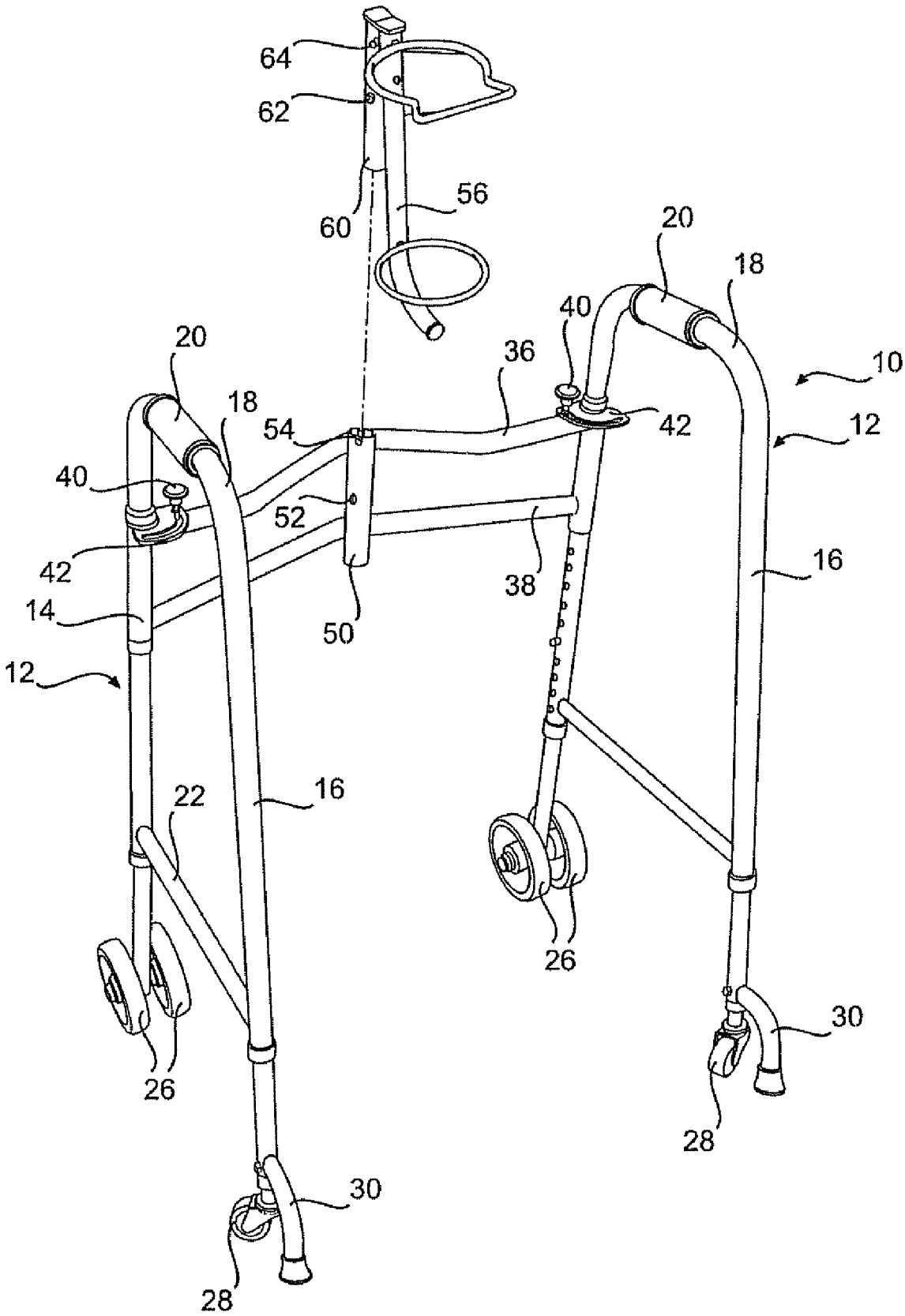
FIG. 2 is a rear perspective view of the walker shown in FIG. 1 with the oxygen bottle carrier attachment shown detached from the mount.
Figure 5:
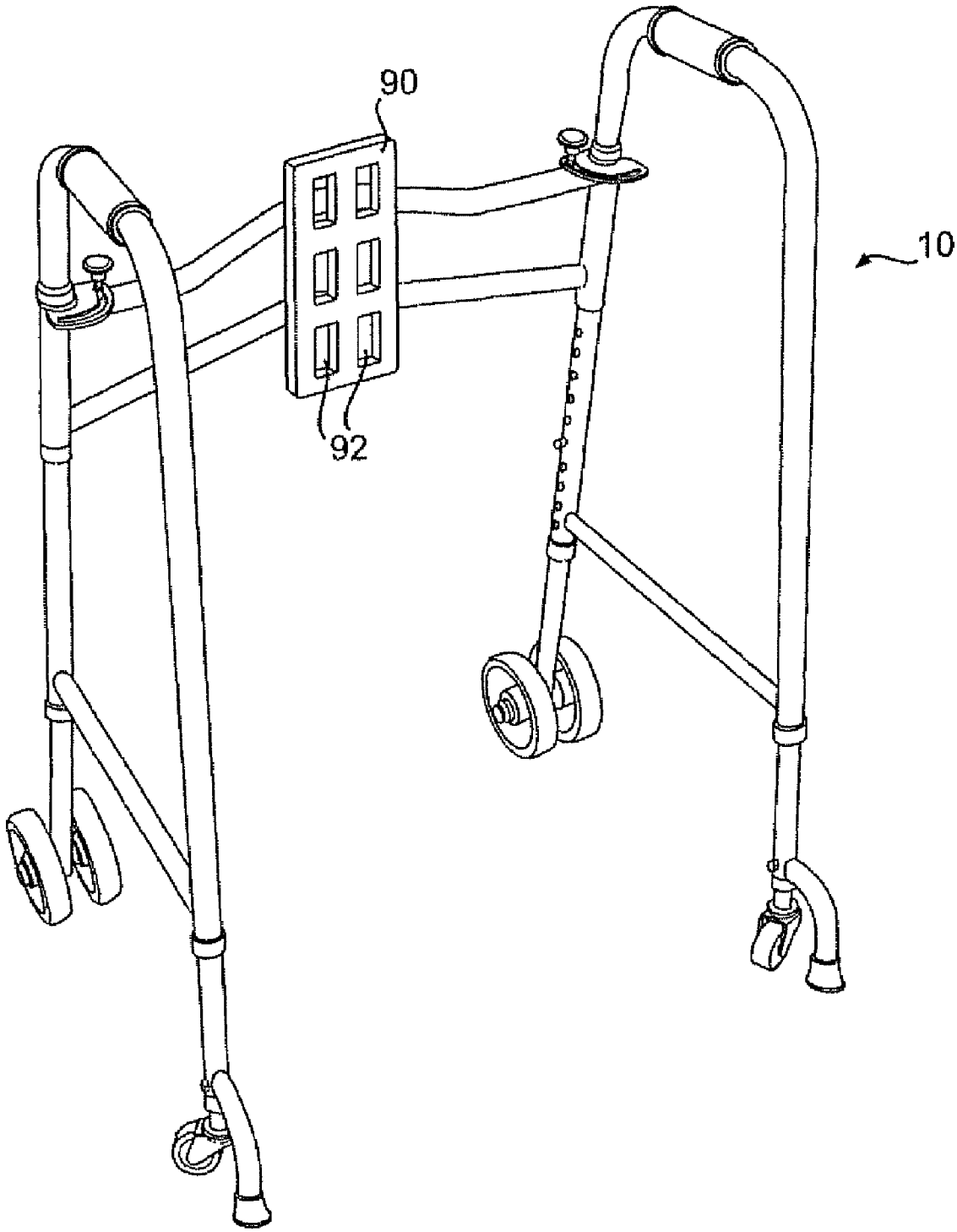
FIG. 5 is a rear perspective view of the walker shown in FIG. 1 having an alternative embodiment of a mount fixed to the cross member.

As best seen in FIG. 2, the mount 50 has a hollow, tubular shape. The mount 50 is shown as being round. It could be square, oval, symmetric, asymmetric, or any other geometry. An advantage of the round shape is that it allows rotational movement of a connector that is received inside the mount 50. Also, the mount 50 is shown as having a sufficient length to provide a rigid support when the connector is inserted therein. Alternatively, a mount could be one or more pieces, for instance, a pair of loops or a ring and a can, etc. Still further alternatively, FIG. 5 illustrates a mount 90 having an alternative construction to the tubular mount 50 shown, for instance, in FIG. 2. Mount 90 includes apertures 92 that could receive hooks or other male inserts from a reciprocal connector (not shown).

In the figures, mount 50 is permanently fastened to the cross members 36 and 38 by welding. The mount 50 may be otherwise permanently fastened by adhesive, rivet, screw or otherwise. In a further example, mount 50 may be removably fastened to the cross members 36 and 38 by clamps or straps and snaps or screws or nuts and bolts. For safety purposes, the fastening of a mount should be very secure and free from any loose movement.

Returning again to FIG. 2, there is shown an aperture 52 in the mount 50. The aperture 52 is a round hole in the mount 50 which is adapted to receive a detent such as detent 62 that is part of the connector 60 shown in FIG. 2. Still further, the mount 50 includes notches 54 open along the top edge of the tubular mount. These notches 54 likewise are adapted to receive a detent like detents 64. The notches 54, in combination or alone with the apertures 52 may allow an attachment such as the oxygen bottle holder 56 to be rotated around inside the mount 50. An attachment with a universal mount 60 may be releasably locked in various orientations around the mount 50. As is evident from the drawings, the universal connector 60 is a circular element adapted to be received within the mount 50. As shown, the connector 62 is the male element, while the mount 50 is the female element that receives the connector. Alternatively, not shown, a mount could be the male element while the connector is a female element.

Figure 3:
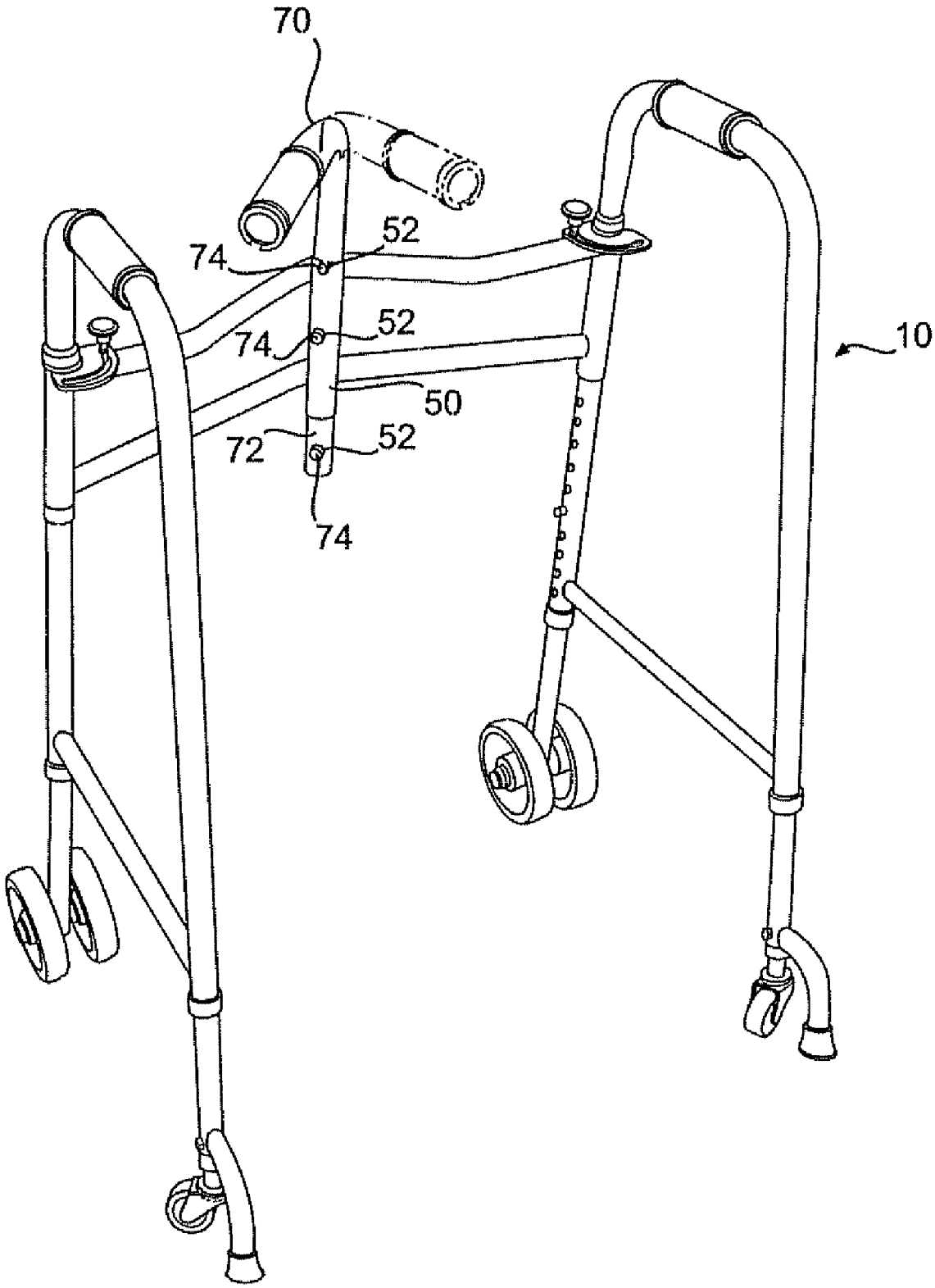
FIG. 3 is a rear perspective view of the walker shown in FIG. 1 having a stroke handle attachment placed in the mount.

The figures show many different attachments. Each attachment has a connector. In FIGS. 1 and 2, an oxygen bottle carrier 56 has a tubular connector 60. In FIG. 3, a handle 70 likewise has a tubular connector 72. In the example of the handle 70, the handle includes a detent 74 that may be received within the aperture 52 and/or the notch 54. Many other types of attachments may be used as long as they include some connector component that is adapted to be received in a mount. The mount 50 in the form of a round tube is especially useful for use with a stroke handle as shown in FIG. 3, because the handle may be rotated to be releasably locked in the right hand position shown in broken lines or the left hand position shown in solid lines. Or the handle may be rotated further around to either side to simplify the storage or transportation of the walker 10 when it is folded.

Figure 9A:
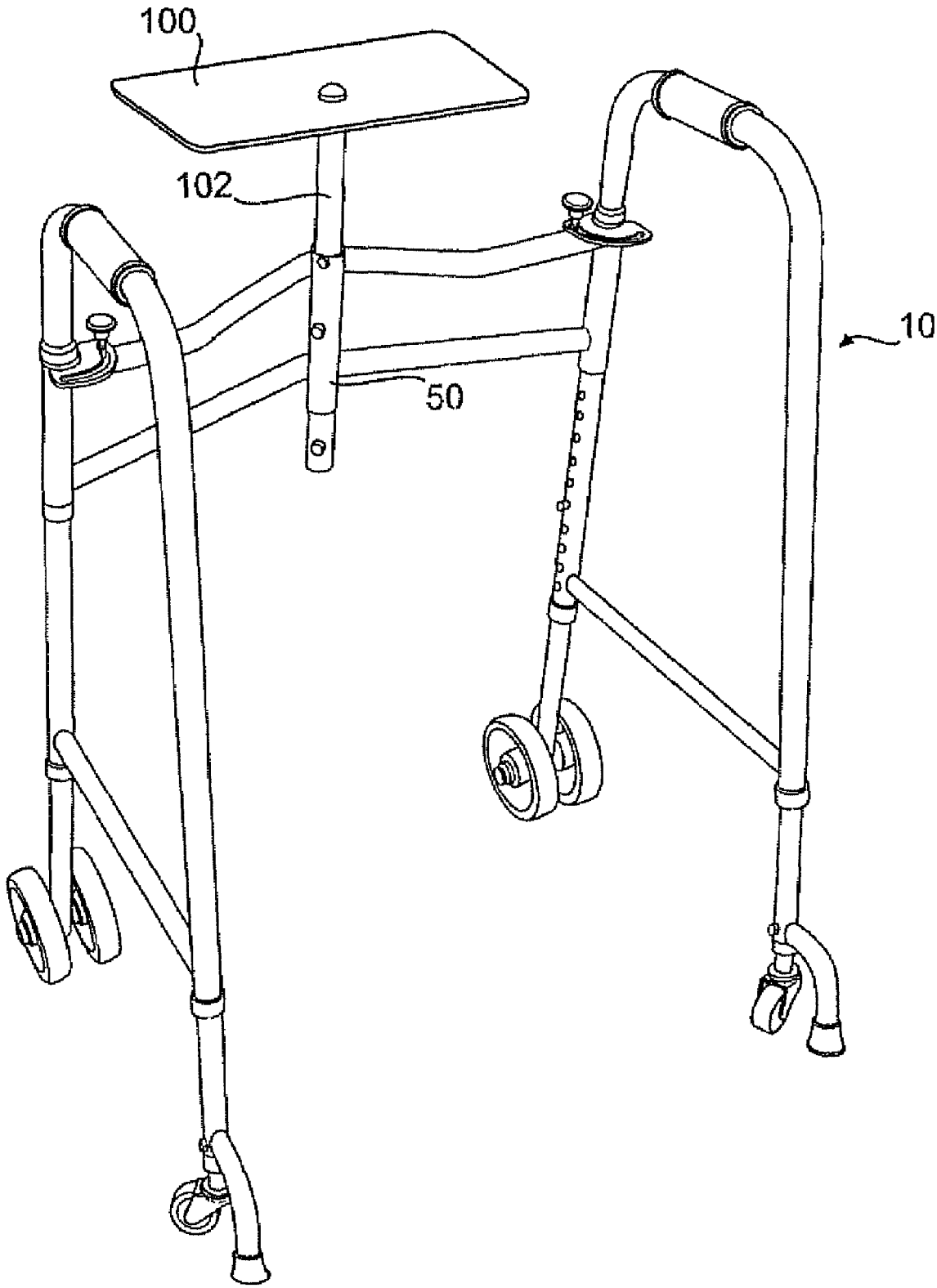
FIGS. 9A-9D are rear perspective views of the walker shown in FIG. 1 showing different attachment examples.
Figure 9B:
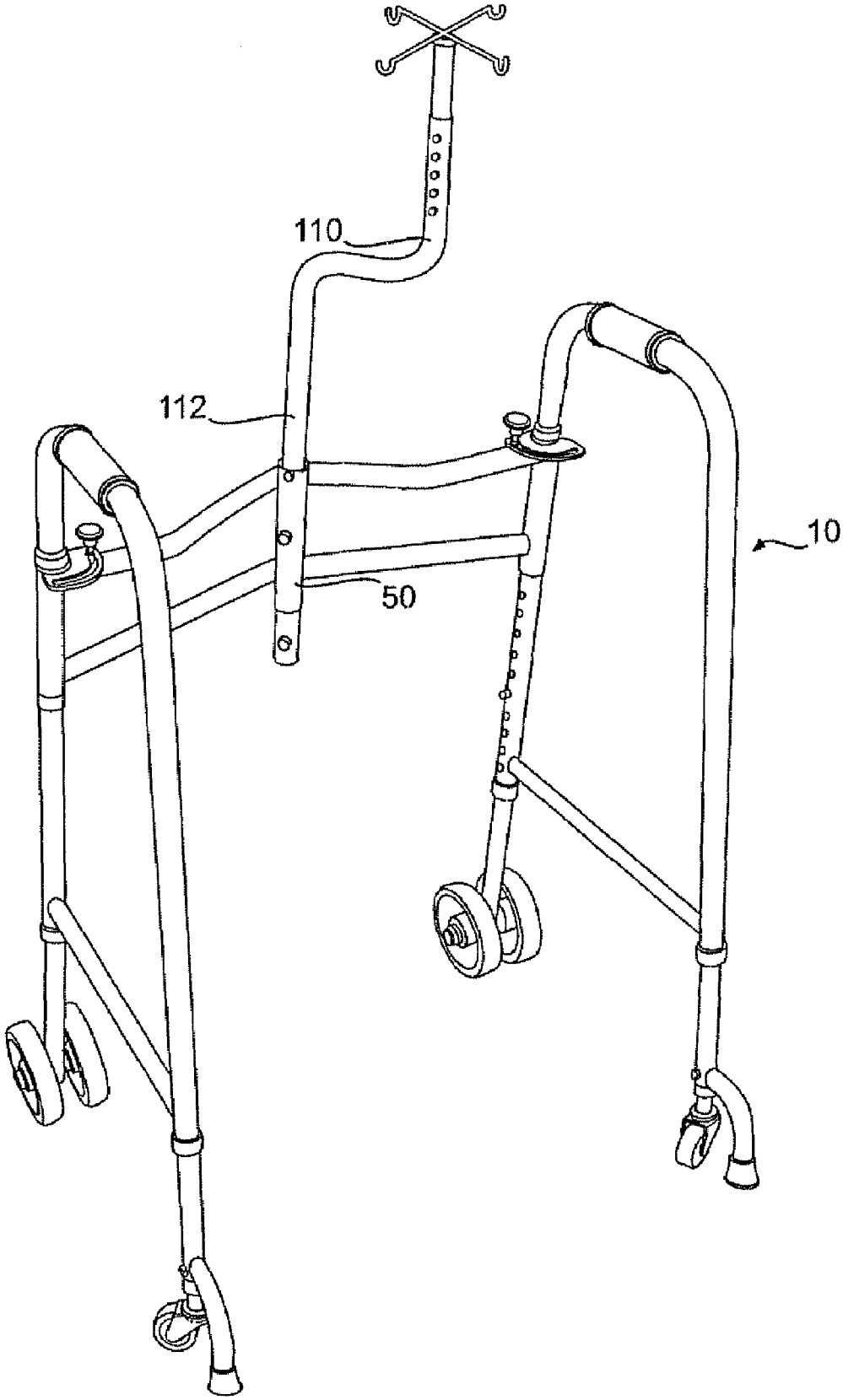
Figure 9C:
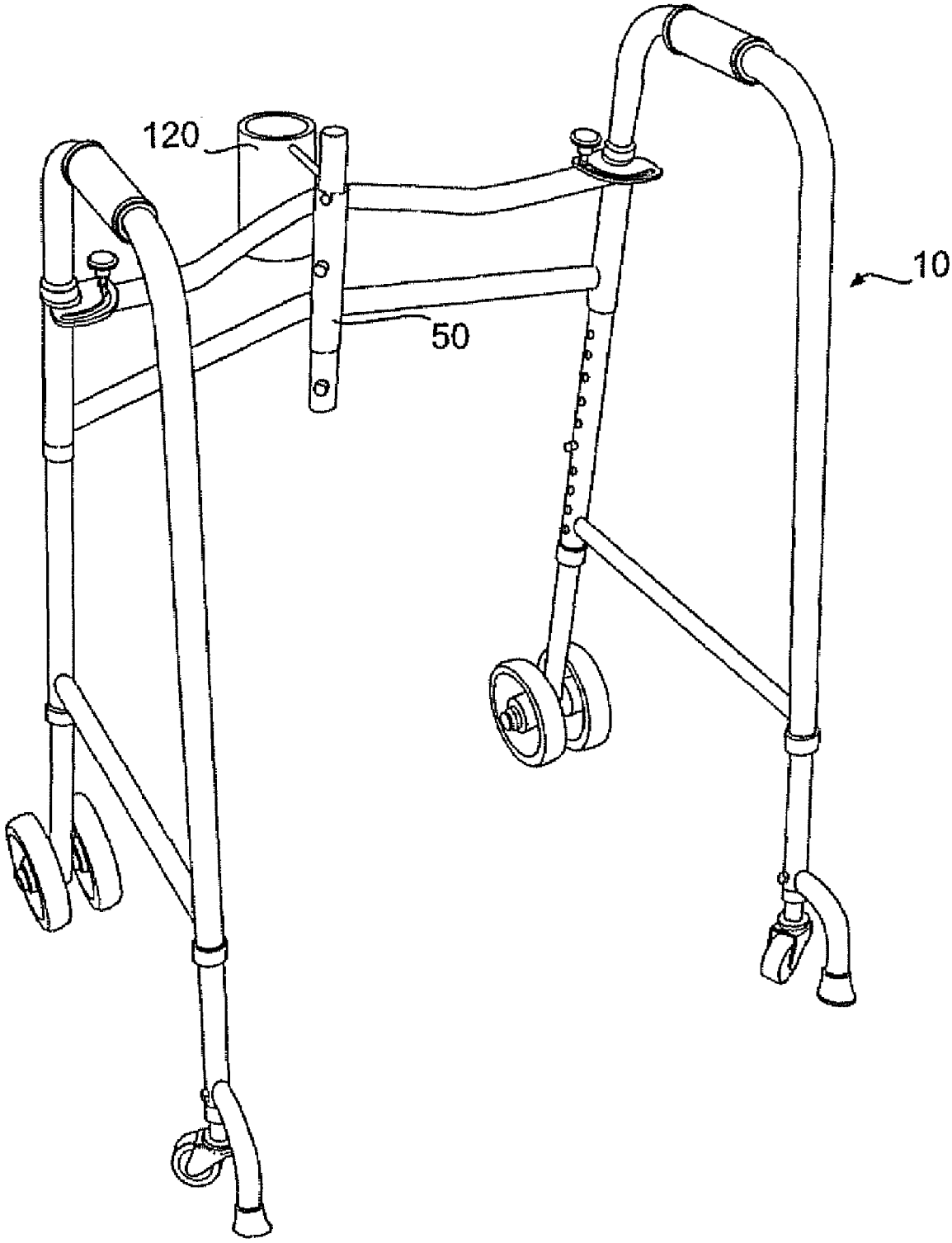
Figure 9D:
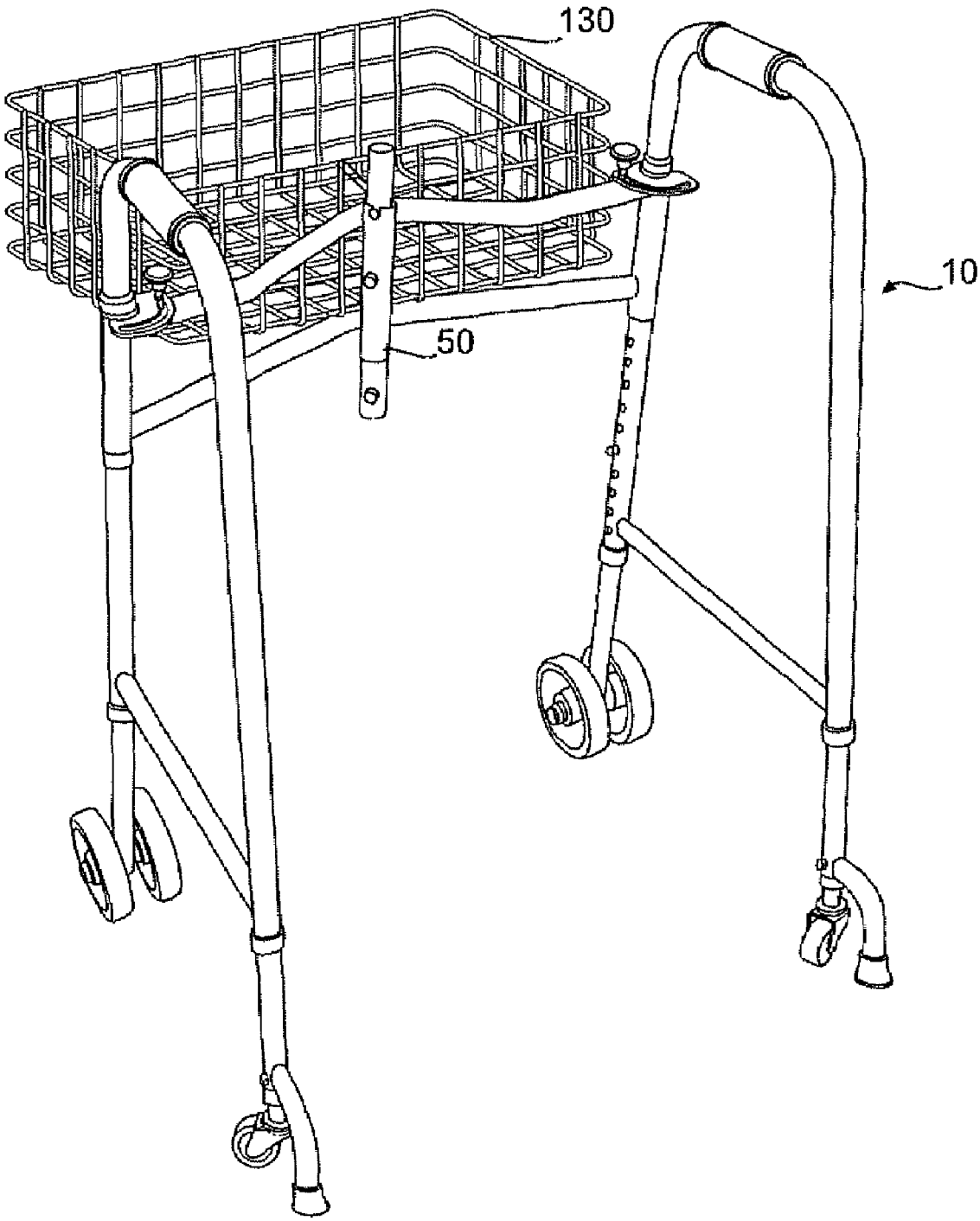

FIGS. 9A-9D illustrate still further the examples of different attachments that may be used in connection with a universal mount 50. In FIG. 9A, a tray 100 has a universal connector 102 that is received in the universal mount 50. As a result of the circular, tubular shape of the universal mount 50 and the universal connector 102, the tray 100 may be rotated to inside or outside positions. The further use of detents (not shown) allow the tray to be locked into at least inside or outside positions. By merely depressing the spring-loaded detent, the tray may be rotated around or removed from the universal mount 50 FIG. 9B illustrates an IV pole attachment 110 that is received in the universal mount 50. The IV pole attachment 110 includes a universal connector portion 112 that is inserted into the mount 50. Again, as a result of the circular, tubular construction of the universal mount 50, the IV pole attachment 110 may be rotated to be releasably locked in the right or left positions depending on the need of a given patient. Detents (not shown) in the universal connector 112 can be received in the universal mount 50 to lock the IV pole attachment 110 in the right or left hand or any other position that may be advantageous. FIGS. 9C and 9D likewise show further attachments. FIG. 9C demonstrates a cup holder 120, while FIG. 9D shows a basket 130. In each case, the attachment is connected to the universal mount 50.

As shown in FIGS. 5-8, alternative mount structures are possible. FIG. 5 shows mount 90 and apertures 92 that may be selectively engaged by male elements of various connectors used in connection with different attachments that may be mounted on the walker 10.

Figure 6:
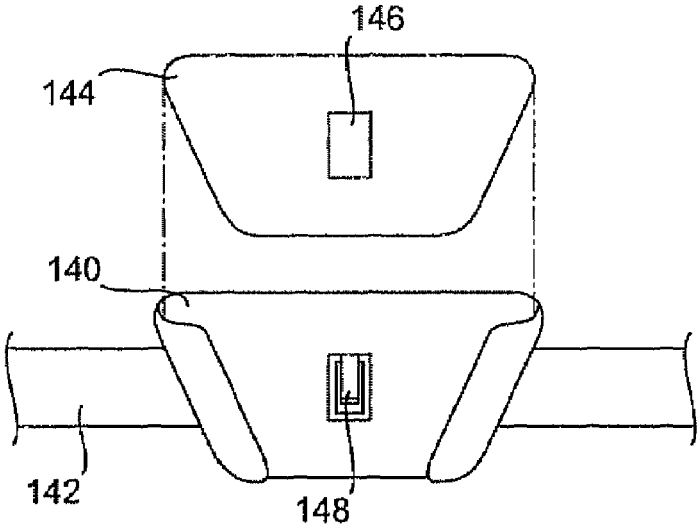
FIG. 6 is a perspective view of an alternative example of a mount fixed to a cross member.

In FIG. 6, a bracket 140 is a universal mount that is fixed on a walker cross member 142. The bracket 140 includes a spring-loaded retaining pin 148. The bracket 140 is shown having a female structure that is adapted to receive the male bracket 144. The male bracket 144 acts as a universal connector to be used in connection with the universal mount/bracket 140. Universal connector 144 is incorporated into any type of attachment that is desirable to be mounted into the bracket 140 including, but not limited to, those attachments otherwise discussed herein. The male bracket 144 includes an aperture 146 which receives the spring-loaded retaining pin 148 that allows the male connector bracket 144 to be releasably locked in place on the mount/bracket 140.

Figure 7:
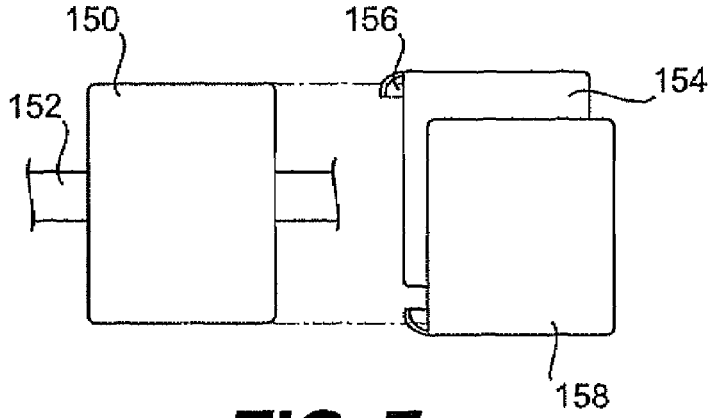
FIG. 7 is a perspective view of a still further example of a mount fixed to a cross member.

FIG. 7 illustrates a still further embodiment of a universal mount 150. The universal mount 150 is a plate that is connected to a walker cross member 152. The mount 150 is adapted to engage a universal connector plate 154. The connector plate 154 includes a top lip 156 and a spring-loaded bottom clip 158. In use, the connector plate is hooked over the top of the mount plate 150. The clip 158 is then depressed and snapped into place around the bottom of the connector plate 150. As with the other mount/connector constructions, the removable securement of the connector plate 154 allows for easy alternate use of various attachments that would be otherwise secured to the connector plate 154.

Figure 8:
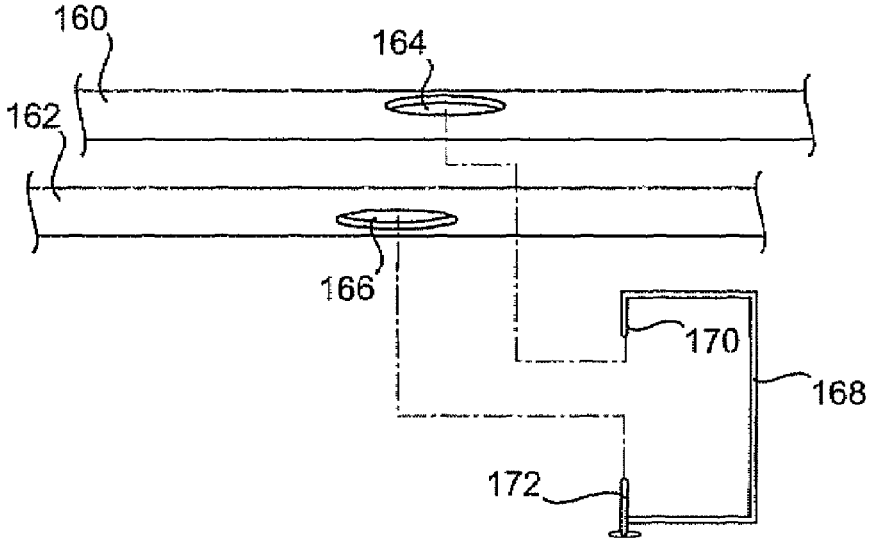
FIG. 8 is a perspective view of an additional mount integral in a cross member.

FIG. 8 illustrates a still further universal mount system that is integral to a walker crossbar. In FIG. 8, a top cross frame bar 160 has a hole 164 integrally formed in the top of that crossbar. Similarly, bottom crossbar 162 has a hole 166 integrally formed in the bottom of that crossbar. These holes 164 and 166 in the cross members 160 and 162 form the universal mount assembly in this alternative embodiment. A universal connector 168 includes a c-shape with a top point 170 that is adapted to be received in the hole 164. Bottom pin 172 of the universal connector 168 is a spring-loaded pin that is adapted to be received in the bottom hole 166. The universal connector 168 is an integral part of any of the attachments that could be used in connection with this system. FIG. 8 is an example of a universal mount that is integrally formed in the cross members 160 and 162 of a walker. A still further alternative construction that may be used would include a single hole in either a top crossbar or a bottom crossbar. A c-shaped universal connector could simply loop over the top bar or under the bottom bar and the opposite bar has a hole in it to receive a spring-loaded pin similar to pin 172. In this way also a universal connector like universal connector 168 can be releasably secured to a cross member of a walker.

In an example of the present invention, a walker such as walker 10 may be made available as a kit with different collections or selections of attachments. For instance, an individual user may determine that they use three or four different attachments on a regular basis. They could purchase as a kit the walker and two or three or four or more individual attachments. When a specific attachment is desired, it can be simply interchanged out if it is not already placed within the mount. Similarly, health care providers such as hospitals or rehabilitation centers may have large stocks of walkers that they require for their different patients and different patient needs. By maintaining a stock of walkers having a universal mount and a stock of a plurality of different attachments that include connectors that are adapted to be received in the universal mount, much greater flexibility is allowed to the care provider so that a lesser inventory of walkers would be necessary.

While the invention has been described with reference to specific embodiments thereof, it will be understood that numerous variations, modifications and additional embodiments are possible, and all such variations, modifications, and embodiments are to be regarded as being within the spirit and scope of the invention.

What is claimed is:

1. A walker assembly for assisting a patient with mobility, the walker assembly comprising:

a pair of side frames, each side frame including a front leg, a rear leg, and a handrail, the handrail joining the upper ends of the front and rear legs;

a cross member connected on each end to each side frame;

a tubular universal mount fixed to the cross member, the tubular mount comprising a circular or non-circular cross-sectional geometry; and a set of a plurality of different attachments wherein each attachment of the set provides a different function, the plurality of attachments adapted to selectively and slidably engage the mount, the mount interchangeably engaging one attachment of the set of plurality of different attachments.

2. A walker assembly as described in claim 1, wherein each side frame further comprises a u-shape defined by the front leg and the rear leg being substantially vertical and the handrail connecting the upper ends of the substantially vertical front and rear legs.

3. A walker assembly as described in claim 1, wherein the set of a plurality of different attachments includes at least two attachments selected from the group consisting of oxygen tank holders, handles, IV poles, baskets, cane holders, trays, armrests, and umbrella holders.

4. A walker assembly as described in claim 1, wherein the tubular element has a plurality of apertures therein, each aperture adapted to receive a detent.

5. A walker assembly as described in claim 1, wherein the tubular element has a plurality of notches, each notch adapted to receive a detent.

6. A walker assembly as described in claim 1, wherein the side frames are rotatably connected to the cross member.

7. A walker assembly as described in claim 6, wherein the side frames are releasably and lockably connected to the cross member.

8. A walker assembly as described in claim 1, further comprising a second cross member, and the universal mount is fixed to both cross members.

9. A walker assembly as described in claim 8, wherein the universal mount is fixed to both cross members on the back side of both cross members.

10. A walker assembly as described in claim 1, wherein the universal mount is fixed to the cross member in the center of the cross member substantially equidistant from each side frame.

11. A walker assembly as described in claim 1, wherein the mount is fixed on the back side of the cross member.

12. A walker assembly for assisting a patient with mobility, the assembly comprising:

a pair of side frames, each side frame including a front leg, a rear leg, and a handrail, the handrail joining the upper ends of the front and rear legs;

a cross member connected on each end to each side frame;

a set of a plurality of different attachments wherein each attachment provides a different function;

a tubular universal mount fixed to the cross member the tubular mount comprising a circular or non-circular cross-sectional geometry, the mount interchangeably receiving one of the attachments from the set of plurality of different attachments; and each attachment from the set of plurality of different attachments having a universal connector adapted to be interchangeably received in the universal mount.

13. A walker assembly as described in claim 12, wherein the universal connector comprises a male element that is received by the universal mount that comprises a female element.

14. A walker assembly as described in claim 12, wherein the set of a plurality of different attachments includes at least two attachments selected from the group consisting of oxygen tank holders, handles, IV poles, baskets, cane holders, trays, armrests, and umbrella holders.

15. A walker assembly for assisting a patient with mobility, the walker assembly comprising:

a pair of side frames, each side frame including a front leg, a rear leg, and a handrail, the handrail joining the upper ends of the front and rear legs;

a set of a plurality of different attachments wherein each attachment provides a different function;

a cross member comprising a universal mount, the mount interchangeably and selectively securing one attachment of the set of a plurality of different attachments; and the universal mount positioned in the center of the cross member substantially equidistant from each side frame.

16. A walker as described in claim 15, wherein the universal mount comprises an aperture in the cross member.

17. A walker as described in claim 16, further comprising a second cross member, and the universal mount further comprises a second aperture in the second cross member.

18. A walker assembly for assisting a patient with mobility, the walker assembly comprising:

a pair of side frames, each side frame including a front leg, a rear leg, and a handrail, the handrail joining the upper ends of the front and rear legs;

a set of a plurality of different attachments wherein each attachment provides a different function;

a cross member comprising a tubular universal mount fixed to the cross member, the tubular mount comprising a circular or non-circular cross-sectional geometry, the mount interchangeably receiving one of the attachments from the set of a plurality of different attachments; and each attachment of the set of a plurality of different attachments comprising a tubular connector, each tubular connector being interchangeably and rotatably received by the mount and each connector being releasably locked in at least one orientation with respect to the mount.

* * * * *